US007836662B2

(12) United States Patent
Lüdi

(10) Patent No.: US 7,836,662 B2
(45) Date of Patent: Nov. 23, 2010

(54) SERVICE CEILING, IN PARTICULAR FOR LABORATORIES, AND METHOD OF INSTALLING SUCH A CEILING

(75) Inventor: Hansjürg Lüdi, Dietikon (CH)

(73) Assignee: H. Lüdi + Co. AG Gas-und Energiesysteme, Regensdorf (CH)

( * ) Notice: Subject to any disclaimer, the term of this patent is extended or adjusted under 35 U.S.C. 154(b) by 0 days.

(21) Appl. No.: 12/053,697

(22) Filed: Mar. 24, 2008

(65) Prior Publication Data

US 2008/0202050 A1 Aug. 28, 2008

Related U.S. Application Data

(63) Continuation of application No. PCT/EP2006/009143, filed on Sep. 20, 2006.

(30) Foreign Application Priority Data

Sep. 22, 2005 (DE) ..... 10 2005 045 453

(51) Int. Cl.
*E04B 9/18* (2006.01)

(52) U.S. Cl. ..... 52/745.2; 52/126.2; 52/220.6; 52/506.6

(58) Field of Classification Search ..... 52/126.2, 52/126.5, 220.6, 220.5, 506.06, 506.08, 745.2, 52/302.1, 302.3
See application file for complete search history.

(56) References Cited

U.S. PATENT DOCUMENTS 922,368 A * 5/1909 Wachtel ..... 52/220.5
2,217,115 A * 10/1940 Harald ..... 52/745.05
2,833,199 A * 5/1958 Wakefield ..... 454/297
3,280,530 A * 10/1966 Rothenbach ..... 52/838
3,353,472 A 11/1967 Lee et al.
3,557,511 A * 1/1971 Curran ..... 52/414
3,742,674 A * 7/1973 Lang ..... 52/666

(Continued)

FOREIGN PATENT DOCUMENTS

DE 1 062 913 8/1959

(Continued)

OTHER PUBLICATIONS

International Search Report, dated Dec. 8, 2006.

*Primary Examiner*—Brian E Glessner
(74) *Attorney, Agent, or Firm*—Laurence A. Greenberg; Werner H. Stemer; Ralph E. Locher

(57) ABSTRACT

A service ceiling is provided for carrying supply lines in a room of a building having at least one aisle region, in particular in a laboratory. The service ceiling is provided with an intrinsically rigid support frame composed of profiled members which is fastened in the region of the ceiling of the room. At least one air inlet duct for feeding in fresh air, and lines for feeding in sanitary media are provided. The service ceiling is distinguished in that the support frame extends in a first plane at a distance from the ceiling of the building, and in that the air inlet duct extends above the aisle region essentially flush with the underside of the support frame, in the plane of the support frame, and in that the lines for feeding in the sanitary media extend above the air inlet duct in a second plane.

16 Claims, 4 Drawing Sheets

U.S. PATENT DOCUMENTS 4,042,287 A * 8/1977 Hallen ..... 312/209
4,286,419 A * 9/1981 Treffers ..... 52/39
4,540,847 A * 9/1985 Gardner ..... 174/491
4,863,223 A * 9/1989 Weissenbach et al. ..... 312/209
4,883,511 A 11/1989 Gustin et al.
5,037,164 A * 8/1991 Weissenbach et al. .... 108/50.02
5,263,290 A * 11/1993 Gardner ..... 52/220.6
5,312,296 A 5/1994 Aalto et al.
5,842,313 A * 12/1998 Murray et al. ..... 52/220.6
6,202,360 B1 * 3/2001 Rattner et al. ..... 52/36.4

FOREIGN PATENT DOCUMENTS

DE 201 02 640 U1 6/2001
WO 91/11272 A1 8/1991

* cited by examiner

SERVICE CEILING, IN PARTICULAR FOR LABORATORIES, AND METHOD OF INSTALLING SUCH A CEILING

CROSS-REFERENCE TO RELATED APPLICATIONS

This is a continuation, under 35 U.S.C. §120, of copending international application No. PCT/EP/2006/009143, filed Sep. 20, 2006, which designated the United States; this application also claims the priority, under 35 U.S.C. §119, of German patent application No. DE 10 2005 045 453.4, filed Sep. 22, 2005; the prior applications are herewith incorporated by reference in their entirety.

BACKGROUND OF THE INVENTION

Field of the Invention

The invention relates to a service ceiling, in particular for laboratories, and to a method of installing such a ceiling. The service ceiling routes supply lines in a room of a building, in particular a laboratory, having at least one aisle region. The service ceiling contains an intrinsically rigid carrier frame composed of profiled members which is fastened in the region of the ceiling of the room, and also at least one air inlet duct for feeding in fresh air, along with lines for feeding in sanitary media.

When setting up research laboratories for chemical or physical research, for example, it is known practice in the building industry to employ ceiling constructions in which the feed lines for exhaust air, inlet air, the technical gases required in the laboratory, and liquids, and power and data lines, etc., within the ceilings are fastened directly to the associated building ceiling with the aid of suitable fastening devices by use of dowels. Since these lines are generally laid successively by different personnel, the problem arises that not only do the lines sometimes extend in a crisscross and alternating fashion in a number of planes, but also that, in addition, because of the individual mounting of the fastening devices, any spatial modifications to an existing laboratory arrangement can only be made with a great deal of effort.

BRIEF SUMMARY OF THE INVENTION

It is accordingly an object of the invention to provide a service ceiling, in particular for laboratories, and a method of installing such a ceiling that overcomes the above-mentioned disadvantages of the prior art devices and methods of this general type, which enables the various feed lines to extend in a structured and ordered manner and which can additionally be subsequently adapted to a modified laboratory structure in a flexible manner. A further object of the invention is to provide a method whereby a service ceiling can be installed in a simple and cost-effective manner.

With the foregoing and other objects in view there is provided, in accordance with the invention, a service ceiling for routing supply lines in a room of a building such as a laboratory, the room having at least one aisle region. The service ceiling containing an intrinsically rigid carrier frame composed of profiled members, having an underside, and fastened to a region of a ceiling of the room, the intrinsically rigid carrier frame extending in a first plane at a distance from the ceiling of the building. At least one air inlet duct for feeding in fresh air is provided. The air inlet duct extends above the aisle region substantially flush with the underside of the intrinsically rigid carrier frame, in a plane of the intrinsically rigid carrier frame. Lines for feeding in sanitary media are provided, the lines extend above the air inlet duct in a second plane.

According to the invention, a service ceiling serves as a horizontal room division, and contains all the integrated service components such as inlet air and exhaust air, power, light, gases, water, communications, etc. The service ceiling is suitable for building new laboratories and converting existing ones, and also for production and research plants and training facilities, in particular for the chemical and pharmaceutical industries.

The service ceiling preferably contains a flexurally rigid system of metal profiles which is configured in its cross section or height in such a way that the air inlet and exhaust duct, busbar, electrical duct, the media supply and the light can be arranged within the service ceiling without crossing. The carrier frame or the basic grid of the service ceiling contains profiled members, made up in particular of primary members, secondary members and ceiling columns. The primary members are divided into central members and edge members. The central members are twice as wide as the edge members. The central members are preferably situated centrally above the central tables of the laboratory.

The ceiling columns serve as connection elements between the building ceiling and service ceiling.

It is possible for a plurality of service ceilings in the form of modules to be installed in a room, with the individual service ceilings of a room being connected to one another by the joined-together edge members. These two edge members together likewise produce a primary member or central member. The service ceiling can be mounted at any desired height.

The air inlet duct is located centrally in the direction of the central aisle between table and/or fume hood workstations.

The exhaust air duct is located parallel to and alongside the edge members.

The lines used to route the various media are arranged, in particular in a U-shape, on the service ceiling and are located centrally above the air inlet duct.

The media columns can be tapped by way of the supply points which are located centrally over the air inlet duct for each quadrant of a laboratory. The supply points are of modular design and can be adapted for each medium that is required. The components of the media connecting points are preferably constructed inline with through-connecting adaptors.

The media columns can be mounted on the carrier system and are displaceable.

The fact that the supply points are located in each quadrant of a laboratory results in that the room can be divided up a number of times by use of partition walls. The flow of inlet air can be routed separately into each divided laboratory section via associated volumetric flow regulators.

The busbar and the electrical duct preferably extend parallel to the media.

Shelf units can be mounted on the central members and edge members.

Partition walls can be mounted below the central, edge and secondary members.

The lighting fixtures/lamps are displaceable and can thus be adjusted, above the central tables and fume hoods, to the various requirements. The lamps are suspended from the secondary members. By virtue of the high cross section of the service ceiling, the lamp type can be chosen freely. The lamps can be displaced longitudinally and transversely with respect to the primary members.

The air inlet duct is configured in such a way that the outlet openings can be disposed to be closable. The entire service ceiling can be closed downwardly by ceiling panels of various colors and materials. It is also possible in this connection for there to be provided, below the outlet openings of the inlet duct or ducts, baffle plates having a multitude of holes whose diameter is smaller than that of the outlet openings, in order to produce a laminar planar flow of inlet air.

The connections with the main, secondary, axial and edge members are preferably made in a flexurally rigid manner and are preferably grounded.

Furthermore, mechanical securing devices can be installed in the ceiling columns, these devices securing the main members against dropping down should the associated fastening device loosen in the course of time.

All accessories such as, for example, known T-shaped slot nuts and threaded plates can be used in all the secondary and main members.

The service ceiling has a high degree of flexibility, is maintenance-friendly, shortens the installation time and reduces costs, since all the connections, ducts and supply lines can be planned uniformly in advance.

The surface nature of the members matches the laboratory surroundings. It is advantageous in this respect if this also applies to the beginning or end of the profiles in order to prevent the outer coating of the members from peeling or flaking when the members are cut to length.

In accordance with an added feature of the invention, a further air inlet duct extends above a further aisle region within the plane of the intrinsically rigid carrier frame, the lines for feeding in the sanitary media in the second plane are routed parallel to one another in a form of a U from the air inlet duct to the further air inlet duct, and extend along the further air inlet duct.

In accordance with a further feature of the invention, electric supply lines and/or data lines are routed parallel to one another, and parallel to the air inlet duct and the further air inlet duct, in the first plane in a form of a U.

In accordance with another feature of the invention, electric lighting fixtures are accommodated on and can be displaced relative to the intrinsically rigid carrier frame in the first plane.

In accordance with an additional feature of the invention, the lighting fixtures have an underside disposed substantially flush to the underside of the intrinsically rigid carrier frame.

In accordance with another added feature of the invention, the lines for feeding in the sanitary media have, integrated therein, self-locking, T-shaped through-connecting adaptors from which the sanitary medium is fed to individual consumers via curved intermediate lines being plugged onto the self-locking, T-shaped through-connecting adaptors.

In accordance with another further feature of the invention, the self-locking, T-shaped through-connecting adaptors of a plurality of the lines for feeding in the sanitary media are disposed adjacent to one another in a block in at least one region of the air inlet duct. The self-locking, T-shaped through-connecting adaptors of a block extend in a direction of the ceiling of the room such that the intermediate lines are routed away from the lines for the sanitary media in a direction of the ceiling.

In accordance with another additional feature of the invention, the individual consumers are media columns extending in a direction of a floor of the room and are accommodated on an underside of the profiled members of the intrinsically rigid carrier frame and are fastened in a displaceable manner at various positions on the profiled members.

In accordance with a feature of the invention, column-shaped spacers are provided for fastening the intrinsically rigid carrier frame to the ceiling of the room. Adjustable mounting plates are provided and the column-shaped spacers are held on the ceiling by the adjustable mounting plates.

In accordance with an added feature of the invention, at least one air exhaust duct is provided which extends substantially parallel to the air inlet duct along the second plane.

In accordance with another feature of the invention, the intrinsically rigid carrier frame is one of a plurality of carrier frames each have an air inlet duct and the lines disposed adjacent to one another in the first plane, and in that adjoining ones of the profiled members of two neighboring the carrier frames each have a height corresponding approximately to twice a width of the profiled members.

In accordance with a further feature of the invention, the profiled members have recesses and the air inlet ducts, the electric supply lines, and/or the data lines are routed through the recesses in the profiled members.

In accordance with a concomitant feature of the invention, the individual consumers are fastened in a displaceable manner via longitudinal slots and slot nuts engaging the profiled members at various positions on the profiled members.

With the foregoing and other objects in view there is provided, in accordance with the invention, a method for installing a service ceiling. The method includes the steps of: assembling a carrier frame from individual profiled members in a region of a floor of a room; disposing at least one air inlet duct for feeding in fresh air on the carrier frame; disposing a plurality of lines for feeding in sanitary media, the lines extending parallel to one another and to the air inlet duct, in a plane above the air inlet duct; lifting the carrier frame together with the air inlet duct and the lines for feeding in the sanitary media as a unit; and fastening the carrier frame at a predetermined distance from a ceiling of the room.

In accordance with an added moded of the invention, there is the further step of disposing column-shaped spacers extending in a direction of the ceiling on the carrier frame and, after the ceiling has been lifted, fastening the column-shaped spacers to the ceiling via adjustable connection elements, in a form of two mounting plates which can be connected to one another by screws.

Other features which are considered as characteristic for the invention are set forth in the appended claims.

Although the invention is illustrated and described herein as embodied in a service ceiling, in particular for laboratories, and a method of installing such a ceiling, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
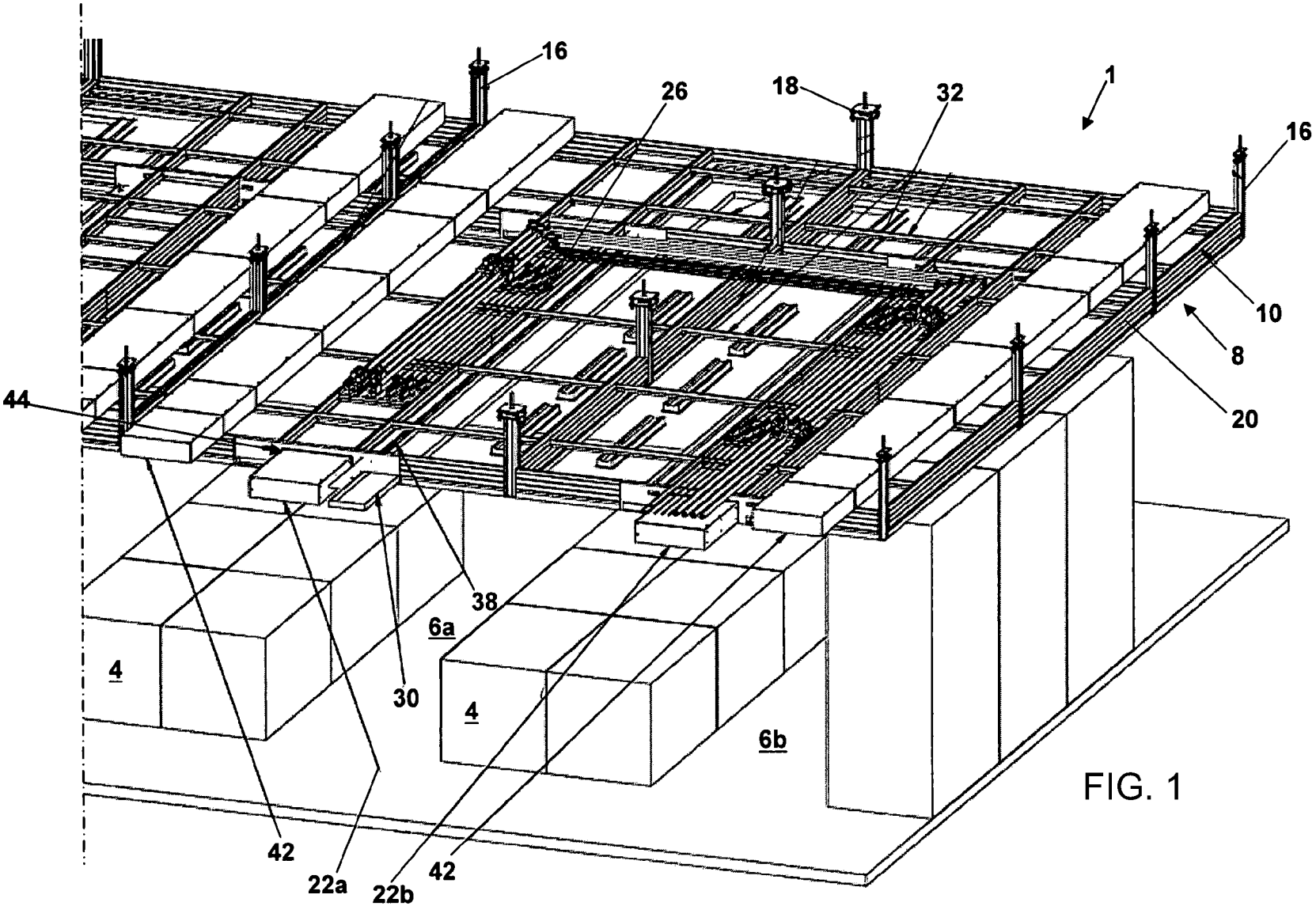
FIG. 1 is a schematic three-dimensional representation of an indicated laboratory room having a service ceiling according to the invention.
Figure 2:
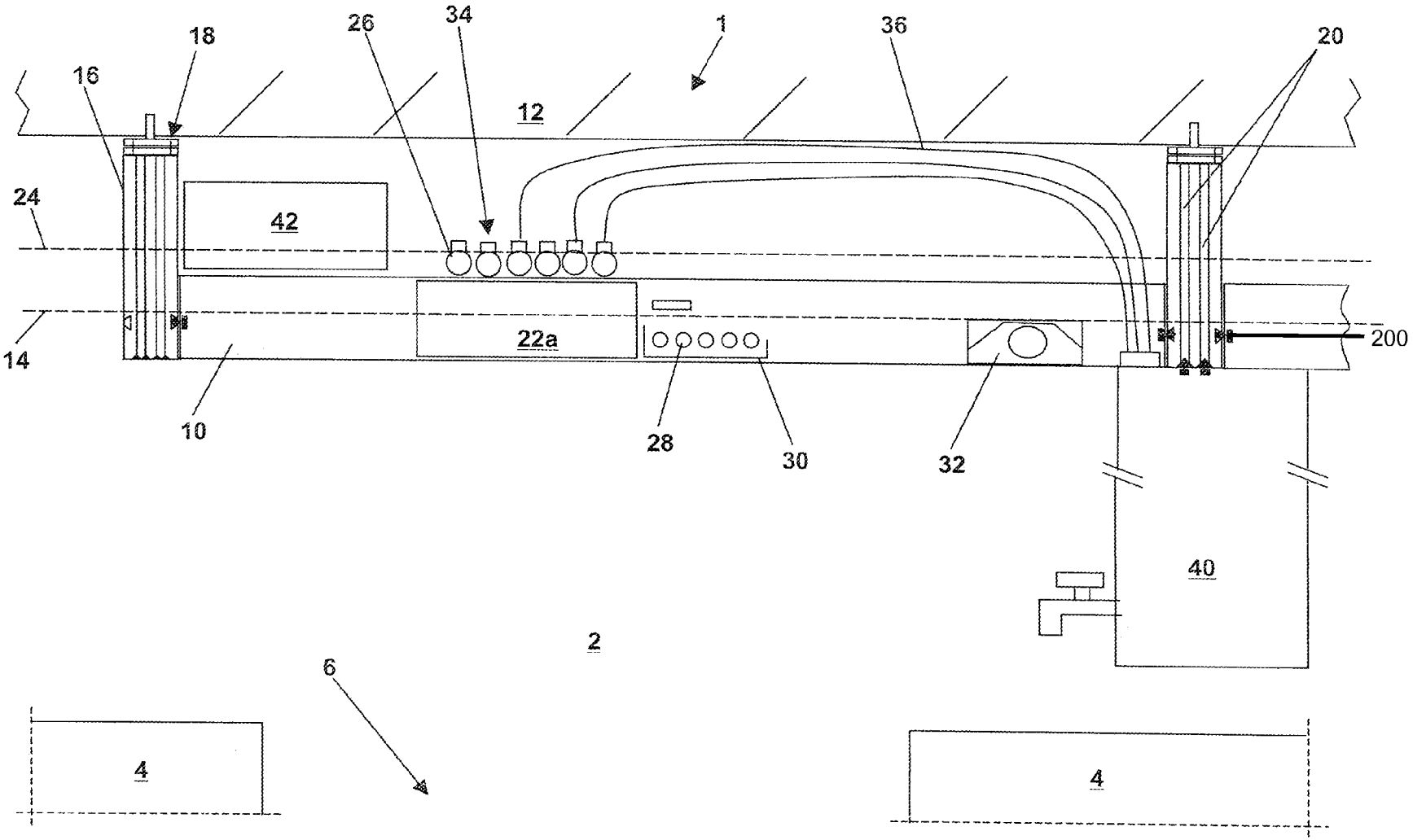
FIG. 2 is a schematic cross-sectional view through a service ceiling according to the invention to illustrate different planes in which inlet and exhaust air ducts, along with supply lines, are routed.

Referring now to the figures of the drawing in detail and first, particularly, to FIGS. 1 and 2 thereof, there is shown a service ceiling 1 according to the invention for routing supply lines in a room 2 of a building, the room being represented in the figures as a laboratory room with indicated laboratory tables 4 and an aisle 6. The service ceiling contains an intrinsically rigid carrier frame 8 composed of profiled members 10 which is arranged in a region of a ceiling 12 of the room 2. As can be observed from the representation shown in FIG. 2, the carrier frame 8 is accommodated in a first plane 14 indicated by a broken line, and is supported on the ceiling 12 by column-shaped spacers 16 which extend downwardly from the ceiling and which, for example, are fastened to the ceiling using two mounting plates 18 which can be adjusted by screws. The spacers are preferably also configured as profiled members which, in the same way as the remaining profiled members 10 of the carrier frame, are provided with slots 20 via which the members can be connected in a known manner by slot nuts 200.

As can also be observed from the representations shown in FIGS. 1 and 2, at least one air inlet duct 22*a* for feeding in fresh air is disposed in the first plane 14, this duct extending above and along the aisle region 6 and its underside extending substantially flush with the underside of the profiled members 10 of the carrier frame 8, as is indicated in detail in FIG. 2. The air inlet duct 22*a* here preferably has a rectangular cross-sectional shape, and has a height which is preferably equal to or slightly less than the height of the profiled members 10 of the carrier frame 8, with the result that the air inlet duct 22*a*—as shown—preferably extends completely in the plane of the carrier frame.

As shown by the representations in FIGS. 1 and 2, according to the invention lines 26 for feeding in sanitary media, such as water, air, vacuum, various technical gases and other liquids, and the like, which are customarily required in a laboratory, are disposed above the air inlet duct 22*a* in a second plane 24. Although, to simplify the description, reference is made only to lines 26 for feeding in sanitary media, these can equally also contain lines for discharging the media.

Figure 3:
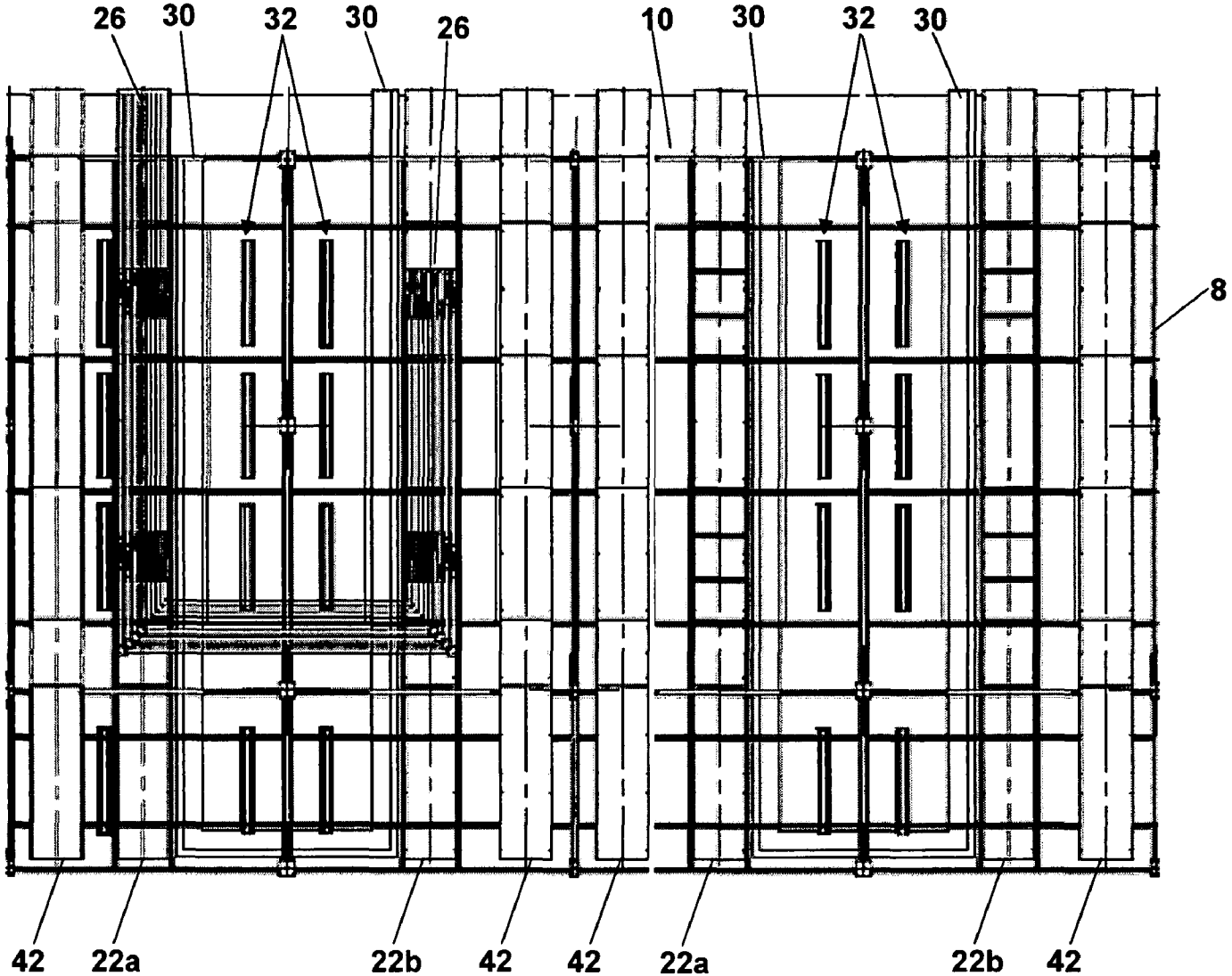
FIG. 3 is a schematic plan view of two service ceilings according to the invention, disposed adjacent to one another, to illustrate an advantageous arrangement of the ducts when there are two or more service ceilings in a laboratory room.

As can also be seen from the representation shown in FIGS. 1 and 3, in the preferred embodiment of the invention, in addition to the first air inlet duct 22*a*, at least one further air inlet duct 22*b* is accommodated within the carrier frame 8 and extends, in particular, above a second aisle region 6*b* within the plane 14 of the carrier frame 8.

As can also be observed from the representation shown in FIG. 1, the lines 26 for feeding the sanitary media in the second plane 24 are preferably routed parallel to one another and in a U shape from the first air inlet duct 22*a* to the further air inlet duct 22*b*, with the first leg of the "U" extending along the first air inlet duct 22*a* and the second leg of the "U" extending along the further air inlet duct 22*b*. The lines here are preferably routed in parallel and adjacent to one another, as is represented in detail in FIG. 4 too.

In the service ceiling 1 according to the invention, electric supply lines and/or data lines 28 are also preferably routed, at the level of the first plane 14, parallel to one another and parallel to the first and second air inlet duct 22*a*, 22*b*, in the form of a U, with a cable duct or electrical duct 30 as shown in FIGS. 1, 2 and 3 preferably being used to route the electric lines 28. In addition, a correspondingly routed busbar 38 can also be provided if desired.

The lines 26 for feeding in the sanitary media and also the electric supply lines routed parallel thereto in the first plane 14 situated below them preferably terminate in the region of one of the two air inlet ducts 22*a*, 22*b*, and in this respect can be closed off by corresponding closures (not shown in detail).

As can also be observed from the representation shown in FIGS. 1 and 2, furthermore, electric lighting fixtures 32 are preferably likewise provided flush to the underside of the profiled members 10 of the carrier frame 8 in the first plane 14, these fixtures being fastened on and displaceable relative to the carrier frame using suitable fastening devices such as slot nuts or the like which engage in the slots 20 of the profiled members 10.

Figure 4:
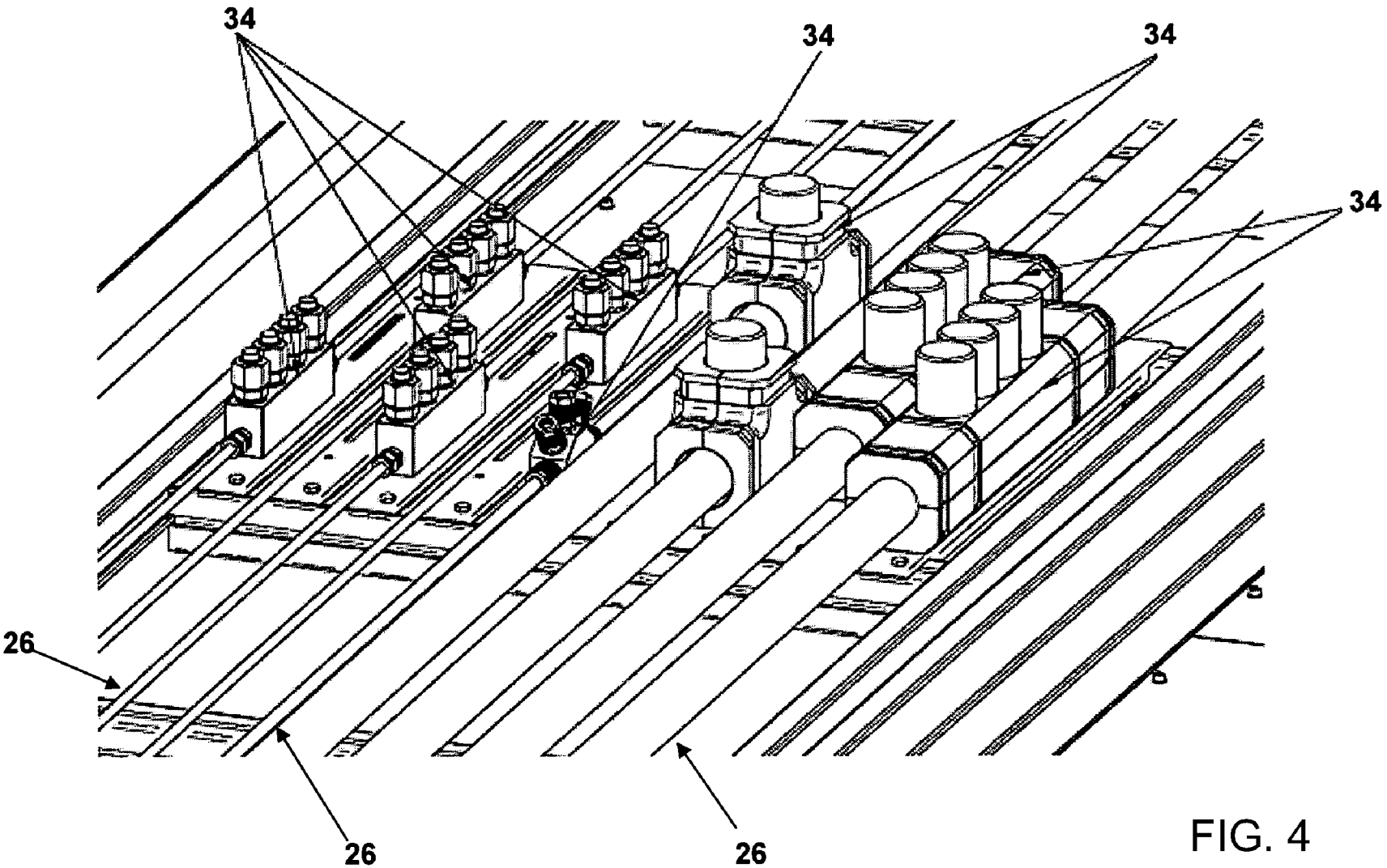
FIG. 4 is a schematic three-dimensional representation of a block-like arrangement of T-shaped through-connecting adaptors for connecting the curved intermediate lines.

The lines 26 for feeding in the sanitary media preferably have, integrated therein, self-locking T-shaped through-connecting adaptors 34, from which the respective sanitary medium is fed to the individual consumers via curved intermediate lines 36 which can be plugged onto the through-connecting adaptors 34, as is shown by way of example in FIG. 2 and FIG. 4.

The through-connecting adaptors 34 of a plurality of the lines 26 for feeding in the sanitary media are in this case preferably disposed adjacent to one another in the form of a block in two regions of the air inlet duct 22*a* and also two regions of the air inlet duct 22*b*, as is indicated, for example, in FIG. 1, in order to provide corresponding central supply points for each carrier frame, for example in four quadrants of a laboratory, from which supply points the sanitary media are routed to the individual consumers via the intermediate lines 36. The consumers may be configured, for example, as media columns 40 which are fastened in a displaceable and freely positionable manner at various positions on the profiled members 10, in particular in the region above the laboratory tables 4, by way of slot nuts engaging in the longitudinal slots 20.

As can be observed in particular from the representation shown in FIG. 4, the connecting adaptors 34 of a block preferably extend in the direction of the ceiling 12 of the room in such a way that the intermediate lines 36 are routed away in the direction of the ceiling 12, the space required for this purpose between the lines 26 and the ceiling 12 being obtained from the height of an exhaust air duct 42 which extends in the second plane 24 preferably on that side of the air inlet duct 22*a*, 22*b* which faces away from an associated aisle 6. The advantage obtained as a result is that the lines 26 and also the electric supply lines 28 and, if appropriate, also the feed lines to the lighting fixtures 32 can in each case be routed in parallel in the form of a "U" in one plane, thus resulting in an optimally structured line routing which allows flexible adaptation to various laboratory arrangements at any time, including retrofitting. This makes it possible for existing laboratories to be reconfigured, expanded or made smaller at some later date with comparatively little effort, since the basic structure of the service ceiling 1 need not be fundamentally modified, and by virtue of the arrangement according to the invention of the lines and ducts in different planes, it is always possible to have ready access to the lines and connecting adaptors 34.

As can also be seen in FIGS. 1 and 3, a plurality of carrier frames 8 can be interconnected adjacent to one another to form a common carrier frame in order to accommodate a multitude of air inlet and exhaust ducts together with runs of supply lines. Here, the cross sections of the adjoining edge members of two neighboring carrier frames 8 are in each case preferably twice as high as wide, with the result that the two members routed in parallel again have a square cross section which makes it possible to line up a plurality of service ceilings 1 in the ceiling grid according to the invention.

According to a further embodiment of the invention, recesses 44 are made in the profiled members 10 of the carrier frame at the level of the air inlet ducts 22*a*, through which recesses the air inlet ducts 22*a*, preferably along with the cable duct 30 and the busbar 38, are routed.

According to a further idea on which the invention is based, the operation of installing a service ceiling 1, which is configured in particular in the above-described manner, involves the carrier frame 8 first being assembled from the individual profiled members 10 in the region of the floor of a room 2, it being possible for the carrier frame to lie either directly on the floor or to be supported on stands or the like. Next, the air inlet duct or ducts 22*a*, 22*b* are arranged, and the lines for feeding in the sanitary media which extend, in particular, parallel to one another and to the air inlet duct are arranged in a plane above the air inlets ducts 22*a*, 22*b*, and the electric supply lines are preferably also mounted.

It is only after all the components have been mounted and the lines have preferably been checked that the carrier frame 8 together with the components mounted thereon is lifted as a unit with the aid of suitable lifting devices, for example pulley blocks anchored on the ceiling 12, and fastened to the ceiling by way of the column-shaped spacers 16, which have likewise already been premounted on the frame 8, and the mounting plates 18. However, as an alternative to mounting by use of the column-shaped spacers 16, there is also the possibility of using a suitable number of support columns to mount the carrier frame 8 from below at a predetermined distance beneath the ceiling.

The invention claimed is:

1. A method for installing a service ceiling, which comprises the steps of:

assembling a carrier frame from individual profiled members in a region of a floor of a room;

disposing at least one air inlet duct for feeding in fresh air on the carrier frame;

disposing a plurality of lines for feeding in sanitary media, the lines extending parallel to one another and to the air inlet duct, in a plane above the air inlet duct;

lifting the carrier frame together with the air inlet duct and the lines for feeding in the sanitary media as a unit; and fastening the carrier frame at a predetermined distance from a ceiling of the room.

2. The method according to claim 1, further comprising providing a further air inlet duct for extending above an aisle region within the plane of the carrier frame, the lines for feeding in the sanitary media in the second plane are routed parallel to one another in a form of a U from the air inlet duct to the further air inlet duct, and extend along the further air inlet duct.

3. The method according to claim 2, further comprising providing at least one of electric supply lines and data lines routed parallel to one another, and parallel to the air inlet duct and the further air inlet duct, in the first plane in a form of a U.

4. The method according to claim 1, further comprising providing electric lighting fixtures accommodated on and can be displaced relative to the carrier frame in the first plane.

5. The method according to claim 4, wherein the lighting fixtures have an underside disposed substantially flush to the underside of the carrier frame.

6. The method according to claim 1, further comprising providing curved intermediate lines; and wherein the lines for feeding in the sanitary media have, integrated therein, self-locking, T-shaped through-connecting adaptors from which the sanitary medium is fed to individual consumers via the curved intermediate lines being plugged onto the self-locking, T-shaped through-connecting adaptors.

7. The method according to claim 6, wherein the self-locking, T-shaped through-connecting adaptors of a plurality of the lines for feeding in the sanitary media are disposed adjacent to one another in a block in at least one region of the air inlet duct.

8. The method according to claim 7, wherein the self-locking, T-shaped through-connecting adaptors of a block extend in a direction of the ceiling of the room such that the intermediate lines are routed away from the lines for the sanitary media in a direction of the ceiling.

9. The method according to claim 8, wherein the individual consumers are media columns extending in a direction of a floor of the room and are accommodated on an underside of the profiled members of the carrier frame and are fastened in a displaceable manner at various positions on the profiled members.

10. The method for according to claim 1, further comprising providing column-shaped spacers for fastening the carrier frame to the ceiling of the room.

11. The method according to claim 10, further comprising providing mounting plates, the column-shaped spacers being held on the ceiling by the mounting plates.

12. The method according to claim 1, further comprising providing at least one air exhaust duct which extends substantially parallel to the air inlet duct along the second plane.

13. The method according to claim 3, wherein the carrier frame is one of a plurality of carrier frames each having one of the air inlet ducts and the lines disposed adjacent to one another in the first plane, and in that adjoining ones of the profiled members of two neighboring carrier frames each have a height corresponding approximately to twice a width of the profiled members.

14. The method according to claim 3, wherein the profiled members have recesses formed therein and at least one of the air inlet ducts, the electric supply lines, and the data lines are routed through the recesses in the profiled members.

15. The method according to claim 9, further comprising providing longitudinal slots formed in the profiled members and slot nuts, the individual consumers are fastened in the displaceable manner via the slot nuts engaging the longitudinal slots at various positions on the profiled members.

16. The method according to claim 1, which further comprises disposing column-shaped spacers extending in a direction of the ceiling on the carrier frame and, after the ceiling has been lifted, fastening the column-shaped spacers to the ceiling via adjustable connection elements, in a form of two mounting plates which can be connected to one another by screws.

* * * * *